United States Patent [19]

Mock

[11] Patent Number: 4,463,940

[45] Date of Patent: Aug. 7, 1984

[54] APPARATUS AND METHOD FOR CONTINUOUS STACKING OF SIGNATURES USING OPPOSED FLOATING CONVEYORS

[76] Inventor: Russell V. Mock, 124 Columbia Heights, Brooklyn, N.Y. 11201

[21] Appl. No.: 435,090

[22] Filed: Oct. 18, 1982

[51] Int. Cl.[3] ..... B65H 39/02

[52] U.S. Cl. ..... 270/54; 271/215; 271/314; 271/184

[58] Field of Search ..... 270/54–58; 271/202, 214–215, 199, 314, 184; 198/571

[56] References Cited

U.S. PATENT DOCUMENTS

| | | | |
|---|---|---|---|
| 2,933,314 | 4/1960 | Stobb | 271/215 |
| 3,501,139 | 3/1970 | Stobb | 271/184 X |
| 4,221,373 | 9/1980 | Hans | 270/54 |
| 4,361,318 | 11/1982 | Stobb | 271/215 X |

FOREIGN PATENT DOCUMENTS

| | | | |
|---|---|---|---|
| 25798 | 8/1963 | German Democratic Rep. | 270/54 |
| 53680 | 11/1967 | German Democratic Rep. | 270/54 |
| 685813 | 4/1961 | Italy | 270/54 |
| 2007195 | 5/1979 | United Kingdom | 271/184 |

*Primary Examiner*—E. H. Eickholt

[57] ABSTRACT

Apparatus and method for continuous collecting, compressing and stacking folded multiple sheet signatures from a press fly end, wherein horizontally conveyed, overlapped signatures are stream-transferred from infeed to vertical stacking position, the apparatus being characterized by a crusher station and a floating compressor station the latter of which has opposed tensioned conveyor belts which are retained in a face to face uniformly flat, negative angular relationship by multiple series-mounted rollers. The rollers are in compression contact with uppermost floating conveyor belts whereby compression is obtained through the signatures indirectly to tensioned lower conveyor belts, the signatures being thus continuously moved in a stream from a precise, endwise overlapping relationship, to a vertical endwise stacked relationship within a stacking receiver. To enhance the transfer function, a signature kicking apparatus engages each signature as it emanates from the floating conveyors, thereby forcing the signatures vertically upward against a stripper bar in the receiver.

10 Claims, 2 Drawing Figures

APPARATUS AND METHOD FOR CONTINUOUS STACKING OF SIGNATURES USING OPPOSED FLOATING CONVEYORS

BACKGROUND OF THE INVENTION

Prior Art

The prior art is best represnted by Anton R. Stobb U.S. Pat. No. 2,933,314, dated Apr. 19, 1960; U.S. Pat. No. 3,438,817, dated Dec. 16, 1969 and U.S. Pat. No. 3,501,139, dated Mar. 17, 1970. These and other devices of the art lack positive control and cause skewing of shingled signatures, due to the common practice of incorporating a large single drum coacting with an outerbelt to impose the transfer function upon the signatures from a given direction and azimuth of conveyance to a stacking receiver which sequentially stacks the signatures at a variant azimuth, precedent to bundling. The use of prior art devices of this sort has required continual adjustment of the outer belt, resulting in a lack of control as transition takes place, frequent damaging and jamming of signatures and the necessity for providing a complex mechanical apparatus for separating and removal of jammed signatures. The removal of skewed and jammed signatures demands a momentary production halt and, as a direct result, creates added production cost.

SUMMARY OF THE INVENTION

A mobile signature transfer and stacking apparatus and method, which insures against skewing of signatures and jamming by the progressive engagement of the signatures initially with crusher rollers and thereafter with opposed timing belts, which are compression mounted the same being engaged by series-disposed rollers. The series-disposed rollers, as distinct from a single drum roller, distribute the conveyor applied compression evenly along a major portion of the precisely overlapped signatures, providing constant compression and there is also speed control over the rapidly moving, highly compressed signatures, resulting in a more economic method of stacking, both as to accessibility to the source and reduction in loss of signatures through jamming and skewing. The respective conveyor belts move at substantially constant speed.

The invention is especially adapted to the stacking of signatures falling within the designations: chop or double parallel or tabloid.

The objectives of the invention as achieved will be apparent from reference to the ensuing drawings in which:

DESCRIPTION OF THE PREFERRED EMBODIMENTS

Figures 1, 2:
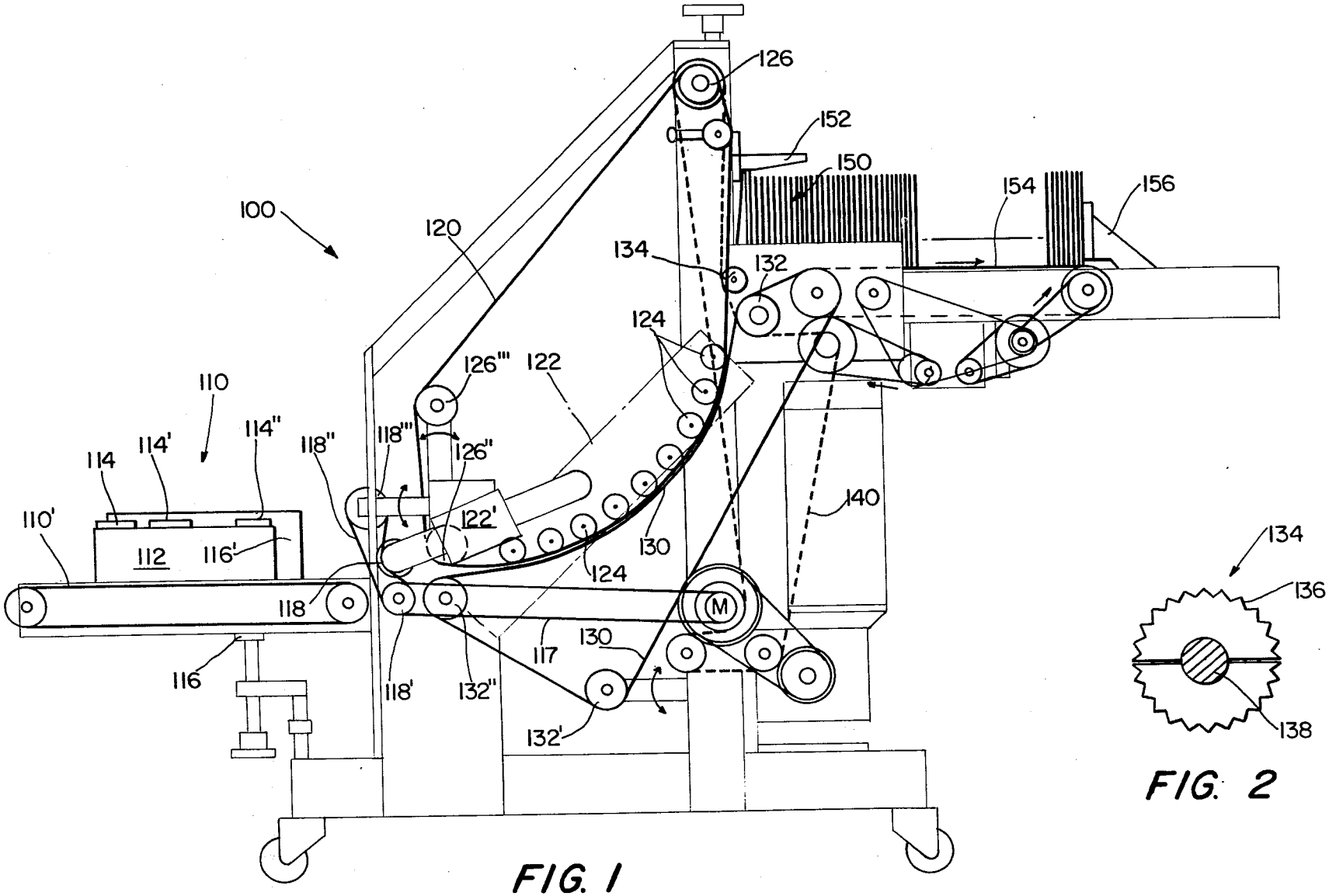
FIG. 1 is a schematic view in vertical elevation of the invention.
FIG. 2 is an enlarged view in side elevation of the topmost signature kickers.

The signature stacker 100 is adapted to continued signature flow from the fly end of a given press. It is so constructed that it may accommodate single or multiple streams of signatures. For multiple streams, stackers may be super positioned above one another, each being connected to a split stream conveyance from the press fly end.

The stacker's major components include input conveyor-jogger 110—110', tension mounted, crusher rollers 118—118', coactive floating conveyor timing belts 120-130, the constant speed control chain 140 for the timing belts and receiver 150. In general, it may be said that folded, overlapped signatures exiting from the fly end of the press are stream conveyed, while channelized along the initial horizontal course, precedent to vertical transition. They are initially crushed between rollers 118 and 118' to exhaust air and compact them. Achieving and holding this compacted condition of signatures is among the objectives of the invention. The stream of shingled or lapped signatures is passed thereafter between topmost and lowermost conveyors which are adapted to maintain a fully compressed state in the signatures during their transition from horizontal conveyance to vertical stacking station. To insure correlative constant speed between the respective transition crushers and conveyors, a speed control chain is interconnected with the respective driven rollers. Leaving the compression zone the stream of signatures having upward thrust is kicked and stopped and simultaneously engaged and jogged in the vertical stacking mode at the receiver 150.

As indicated, the principal function of the stacker 100 is to facilitate handling of folded, printed paper media which is delivered from a web offset press in the forms of either chop, double parallel or tabloid. The stacker 100 being portable is placed in-line with a printing press or combination folder, or plow folding station wherein the flow of the folded media is sustained in a stream. This stream moves continuously from the press, folder or plow, into and out of the stacker for palletizing or bundling of the product. The folded media, otherwise identified as signatures, are moved through the stacker in a shingled stream. By design modification, the stacker is capable of accommodating plural streams of such signatures. As the flow of folded paper media continues into and out of the stacker conveyors they are receiver stacked, in this instance vertically. Simultaneously the stacked product is placed upon a skid pallet or into a box for shipment. By slight modification, the apparatus is adapted to horizontal or incline stacking as well, the overall principals governing the stacking function being essentially as hereinafter described.

In FIG. 1 it will be noted that the paper stacker 100 comprises on the left hand an in-feed conveyor 110 which is adapted to raising or lowering the stream of signatures into the complementary disposed transfer apparatus hereinafter described. Horizontally disposed feed conveyor 110 is preferably composed of four separate endless belts, spaced laterally a few inches apart. These belts moving at the same speed, convey the signatures in a shingled stream relationship. A coactively disposed vertical jogger 112 is laterally adjustable, relative to the feed conveyor 110' to accommodate signatures of variant width. Jogger 112 may comprise two opposed sets of vertical spindles 114—114'-114''. Each set is disposed sidewise of the conveyor 110. Otherwise, a jogger and opposed slide plate will suffice. The jogger supports a jogger belt 112' in an open entry and closed exit relation to the conveyor 110'. Thus, the first pulley 114 is laterally offset, outwardly from pulleys 114' and 114'' to effect a wide open entry. This would insure entry of displaced signatures, precedent to jogging them into alignment in the stream. There are connected to the jogger 110', jogger spindles 114—114'-114'', jogger plate 116' and its driver 116 all mounted upon the stacker frame. During jogging the signatures are, by activity of the system 110–110', constantly being aligned edgewise and moved forward.

Succeeding the conveyor-jogger 110—110' in-line, are two opposed crusher roller 118—118'. Lower roller 118' is journalled in the stacker frame and is driven by motor M through drive chain 117''. By the same token, opposed upper crusher roller 118 has positive driving connection through chain 118'' with the opposed roller 118'. Roller 118 is thus in floating vertical adjustment relative to its counterpart. Pulley 118''' is pivoted and spring loaded, relative to the chain 118'' and being connected to its associated tension arm dances with the continuous flow of the shingled signatures. The opposed position of the crusher rollers 118—118' is further controlled by weighted lever arm 122', acting upon floating roller 118. Lever arm 122', thus has endwise axial engagement with the uppermost roller 118, placing further pressure on the shingled signatures, to exhaust air and compact them in their transition from the horizontal to the vertical. The weighted lever 122' has pivot connection at its opposite end with the opposed plates 122. These plates are fixed to opposite sides of the frames amd serve also as a journal for the associated outer conveyor rollers 124. The primary functions of the crusher rollers are: to express excess air from the signatures, while at the same time flattening them during the course of their initial travel into the transition mode. No skewing of the signatures occurs here or hereafter.

As the signatures continue to travel through the stacker, they are compression engaged by superposed floating conveyors 120 and 130. Both conveyors 120–130 each comprise four endless timing belts, laterally spaced a few inches apart from one another. These belts are known in the trade as H-belts. They are tensioned by means of pulleys 126'–126''–126''' and 132'. Each belt of the conveyor 120–130 moves, as do the crusher rollers, at a constant relative speed, the speed control 140 of which is obtained through engagement of drive chain 140 with sprockets of the conveyors, viz: 126,132 and kicker 134.

Floating conveyor is held arcuately by nine series-disposed rollers 124, each being mounted in the journal plates 122. Each conveyor roller 124 measures approximately $1\frac{3}{4}$ inches in diameter. The conveyor 130, while not directly contiguous to conveyor rollers 124, indirectly applies compression against the conveyor 120 and the rollers 124 via the signatures which are conveyed between floating conveyors 120 and 130. This system creates a suitable compression zone for the safe passage of the lapped signatures through transition from horizontal to vertical, precedent to actual stacking. As will be apparent, the multiple belts comprising conveyor 120–130 are driven the same relative speed by drive spocket 132 which is directly rotated by the driving of chain 140, reference engagement with the respective conveyor sprockets 126–132. Idler sprockets 126'' and 132'' are disposed, as will be noted at the entry to the compression zone. Idlers 126' and 132' are spring loaded to effect the compressive floating function upon the respective conveyors 120 and 130. Key to effecting a successful transition is the co-active maintenance of compression upon the shingled signatures, from initial entry between the crusher rollers 118—118' through the conveyors 120–130. To achieve the objectives, the crusher rollers 118—118' compression conveyors 120–130 are all be rotated at the same relative speed reference interconnection with driver 140.

Leaving the compression zone defined by journal plate 122 and rollers 124, the signatures have now essentially completed the transition from horizontal position to vertical. At this juncture, the signatures will be individually engaged by two centrally disposed, spaced apart kicker wheels 134, the same being centrally mounted upon a needle bearing 136, above the belts of conveyor 130. They are full split for removal so that the parallel timing belts comprising the conveyor 130 may be adjusted laterally. See, in this connection FIG. 2 wherein wheels 134 are shown as having circumferentially disposed teeth 136.

Each signature, being kicked upwardly strikes an adjustable receiver tripper bar 152 and is displaced sidewise from the stripper bar 152 by a following signature, to be subsequently engaged by delivery table conveyor belts 154, all while in a vertically aligned upstanding position. Each new stack is movement controlled by the imposition of a slidable product engaging backstop 156, which is placed to engage the stacked product as it moves along the slide 154. To assist in the stacking function upper and lower joggers, not shown, may be in the receiver to complement the slide function.

Various controls are incorporated to effect a self-contained portable unit. For example, the principal driving motor is provided with a safety clutch, designed to slip in occurence of overload, thereby preserving balance of the unit. The entire unit moreover, is frame mounted on caster wheels whereby it may be moved into and out of operative connection with combination folder, plow station and/or press. As will be apparent the conveyor 120 and 130 are respectively tensioned by spring loaded and gravity weight, reference the pullleys 126', 126'' and 132'.

I claim:

1. A signature stacker adapted to the production of stacks of one or more incoming streams of lapped signatures comprising:

A. a stacker frame having input and output ends;

B. a signature crusher station which is mounted adjacent the input end;

C. a compression conveyor station which is mounted on stream with the crusher station, said compression conveyor station including opposed floating conveyors, at least one conveyor being compressed in contiguous opposition to the other; said conveyors defining by means of plural rollers a support path for one conveyor to effect an arcuate upward transition from the signature crusher station;

D. a signature receiver station, located on stream of the compression conveyor at the output end of the stacker, said receiver guiding successive signatures into stacking registry with one another;

E. means activating the crusher and conveyor stations.

2. The stacker of claim 1 wherein a signature kicker is disposed in extension of the compression conveyor, intermediate the conveyor and receiver, said kicker having connection with the activating means.

3. The apparatus of claim 1 wherein the signature crusher station comprises opposed rollers at least one of which is retained in spaced moveable compression relation to the other.

4. The apparatus of claim 2 wherein the signature crusher station comprises rollers at least one of which is retained in spaced moveable relation to the other.

5. A signature stacker adapted to the production of stacks of one or more incoming streams of lapped signatures comprising:

A. a stacker frame having input and output ends;

B. a signatue in-feed conveyor-jogger station disposed at the input end of the frame;

C. a signature crusher station which is mounted on stream with the in-feed conveyor station;

D. a compression conveyor station which is mounted on stream with the crusher station, said compression conveyor station including opposed floating conveyors, at least one conveyor being compressed in contiguous opposition to the other, said conveyors defining by means of plural rollers a support path for one conveyor to effect an arcuate upward transition from the signature crusher station;

E. a signature receiver station, located on stream of the compression conveyor at the output end of the stacker, said receiver guiding successive signatures into stacking registry with one another;

F. means activating the crusher and conveyor stations.

6. The stacker of claim 5 wherein the in-feed conveyor station includes a signature jogger.

7. The stacker of claim 5 wherein a signature kicker is disposed in extension of the compression conveyor.

8. The stacker of claim 6 wherein a signature kicker is disposed in extension of the compression conveyor.

9. The stacker of claim 7 wherein a signature kicker is disposed in extension of the compression conveyor.

10. The stacker of claim 8 wherein a signature kicker is disposed in extension of the compression conveyor.

* * * * *